United States Patent [19]

Palafox

[11] 4,161,259

[45] Jul. 17, 1979

[54] STACKABLE CONTAINER FOR BOTTLES AND THE LIKE

[75] Inventor: Federico V. Palafox, Naucapan de Juarez, Mexico

[73] Assignee: Procesos Plasticos, S.A., Mexico

[21] Appl. No.: 842,989

[22] Filed: Oct. 17, 1977

[51] Int. Cl.[2] ..... B65D 1/26; B65D 25/06

[52] U.S. Cl. ..... 220/21

[58] Field of Search ..... 220/21,

[56] References Cited

U.S. PATENT DOCUMENTS

| | | | |
|---|---|---|---|
| 3,092,284 | 6/1963 | Stout | 220/21 |
| 3,106,308 | 9/1963 | Kazimier | 220/21 |
| 3,151,761 | 10/1964 | Cloyd | 220/21 |
| 3,314,568 | 4/1967 | Cloyd | 220/21 |
| 3,390,801 | 7/1968 | Adomat | 220/21 |
| 3,391,814 | 7/1968 | Box | 220/21 |
| 3,392,869 | 7/1968 | Needt | 220/21 |

FOREIGN PATENT DOCUMENTS

| | | | |
|---|---|---|---|
| 567968 | 10/1975 | Switzerland | 220/21 |
| 1117704 | 6/1968 | United Kingdom | 220/21 |
| 1297456 | 11/1972 | United Kingdom | 220/21 |

*Primary Examiner*—George E. Lowrance

*Attorney, Agent, or Firm*—Roylance, Abrams, Berdo & Farley

[57] ABSTRACT

A rectangular integrally molded plastic container for bottles having inner partition walls dividing the container into cells. The partitions have openings from cell to cell and the bottom has holes below the openings with annular strengthening flanges. Rigidity of the bottom wall is improved by ribs extending between the flanges. A hole in the center of each is surrounded by inner and outer conical surfaces and is crossed by tapered ribs to conform to the bottom of a bottle in the cell and the top of a bottle in a lower container when such containers are filled and stacked.

5 Claims, 4 Drawing Figures

STACKABLE CONTAINER FOR BOTTLES AND THE LIKE

This invention relates to an improved receptacle for bottles or the like and, particularly, to a stackable box having compartments therein.

BACKGROUND OF THE INVENTION

At the present time there exist several patents relating to boxes made from various kinds of plastic materials which are designed to offer advantages and, at the same time, have the intention of eliminating shortcomings of other designs.

One example of such a box made using blown or injected plastic is Mexican Pat. No. 91,634, which has an exterior shape in the form of a parallelepiped with openings in the upper face to receive bottles and with cavities in the bottom to receive therein the caps of bottles placed in a similar lower box when the boxes are stacked upon each other. These boxes have a severe disadvantage in that, because the bottoms of the boxes are closed, it is difficult to clean or drain liquids which may get into the boxes. In addition, they are brittle and cannot be repaired.

Another embodiment of a box intended as an improvement is shown in Mexican Pat. No. 108,110, in which the partitions forming cells for the bottles are placed in a zig-zag fashion and the partitions are extended upwardly above the bottles in order to form a handle. Although this formation facilitates handling of the box, it makes it impossible to stack the boxes which is very inconvenient in locations such as plants and warehouses.

Another form of box is shown in Mexican Pat. No. 109,292, the height of which is equal to that of the bottles to be stored. In this box, the side walls wholly cover the bottles and, when they are stacked, the upper edge of the lower box makes contact with the lower edge of the upper box. The disadvantage in this box is that a great deal of material is necessary to make the boxes and, consequently, the cost thereof is high. Additionally, they occupy a great deal of space even when empty and this makes it more difficult to transport the boxes in an empty condition.

Still further, there are boxes of specific designs to be used, for example, in combination with certain machinery as illustrated by Mexican Pat. Nos. 140,875 and 116,501, but these containers are based upon ideas and functions not corresponding to the goals of the present invention.

A further form of boxes for bottles which is intended to eliminate all of these shortcomings includes openings at the bottom of the box which facilitates cleaning and at the same time avoids accumulation of liquids in the bottom. The lateral walls are low compared to the bottles so that when the boxes are piled up, they do not rest on the walls, but rather rest on the caps or tops of the bottles which are provided in a lower box. However, this form of box can have serious disadvantages. One is that as they are made of plastic material and as this is generally a smooth polished material, the boxes tend to slip, particularly when they are resting upon bottles covered with metal caps. The caps are also polished, and the boxes tend to slip, particularly when carried in trucks, raising a serious risk. In order to overcome this disadvantage, it has been suggested to place round pieces of rubber around the periphery of the box bottoms (Mexican Pat. No. 76,520) with the intention that when a box is placed upon another box, the caps of the bottles in the lower box contact the rubber pieces, thus avoiding possible slipping. This is not an effective solution because it does not effectively eliminate such slipping.

Another solution to this inconvenience consists in making holes in the bottom of the boxes to receive the bottle caps of bottles held in a lower box to avoid the slipping. However, this system is not effective and it has been proven in use that when a box filled with bottles is removed from the top of a stack, particularly when the stack is of a height on the order of a meter, the workers removing the box pull it in order to carry it away and, with this motion, in view of the fact that the caps protrude into holes in the bottom of the top box, there is a risk of the bottles being broken at the collar or a risk that caps are pried away, resulting in damage to the bottles and the material therein.

It has been suggested to overcome this problem by making wide and shallow holes at the box bottoms, intending to obtain a good hold between boxes and bottles and to promote ease of separation when necessary without the risk of breaking the bottles. However, because these holes are of a relatively large diameter and can permit the introduction into the upper box of almost all the neck of the bottle, the purpose sought is jeopardized. In order to avoid this advantage on the upper part of the hole, there have been provided ribs which may have several forms, such as a cross, a star, radial ribs, and the like. These ribs do not permit the bottles to protrude very much into the upper box but, at the same time, there is a weakness in the bottom of the box and for this reason the ribs tend to break, particularly when several boxes with filled bottles are stacked upon each other. It will be recognized that in such a case the lower boxes will carry the entire weight entirely upon those ribs which are simply insufficiently strong to hold this weight and therefore break, particularly if the stack of boxes is carried upon a bouncing truck.

BRIEF SUMMARY OF THE INVENTION

An object of the present invention is to provide a box for holding bottles which includes, among other features, means at the base of the box to avoid slipping when stacked, and openings at the bottom which permit for easy cleaning without loss of rigidity. This permits stacking a number of boxes which resist breakeage and save a great deal of material in the manufacture.

Briefly described, the invention comprises an improved container for holding and transporting bottles and the like comprising a unitarily formed parallelepiped container having pairs of rectangular side and end walls, a bottom wall and a plurality of longitudinally and transversely extending inner walls, said inner walls intersecting to divide said container into a plurality of cells adapted to receive bottles, means at the corner junctions of said side and end walls forming a double wall structure including spaced, parallel wall portions, said end walls including means extending between the upper portions of said corner junctions defining a handle, means in said inner and end walls defining spaced apart openings extending upwardly from said bottom wall, at least some of said openings being located at the intersections of said inner walls, means in said bottom wall defining a first plurality of generally circular holes, at least some of which are located below said openings, means in said bottom wall defining a second plurality of holes, each of the holes of said second plurality being substantially centrally located in said cells and being of a smaller diameter than the tops of bottles to be received in said cells, and rib means integrally formed on said bottom wall for improving the rigidity thereof, said rib means including a first plurality of ribs extending across the inner surface of said bottom wall between the holes of said first plurality of holes.

In order that the manner in which the foregoing and other objects are attained in accordance with the invention can be understood in detail, a particularly advantageous embodiment thereof will be described with reference to the accompanying drawings, which form a part of this specification and wherein.

Figure 1:
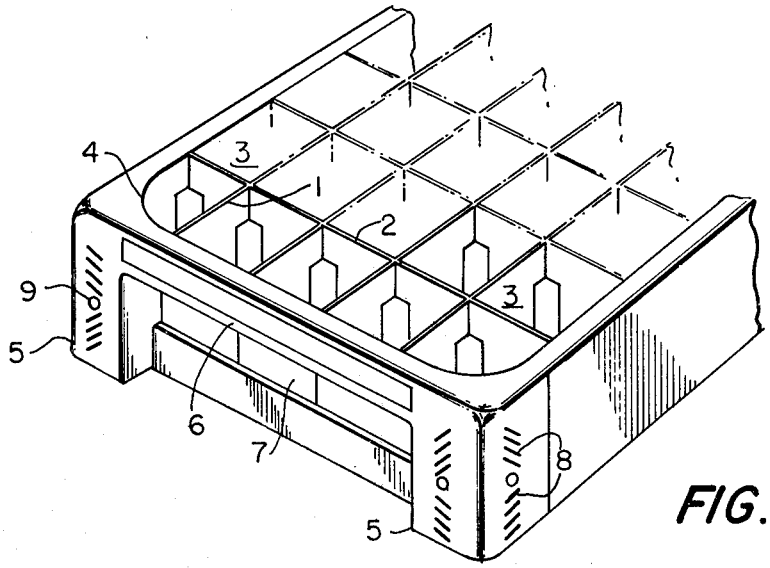
FIG. 1 is a partial perspective view of a container in accordance with the invention.
Figure 3:
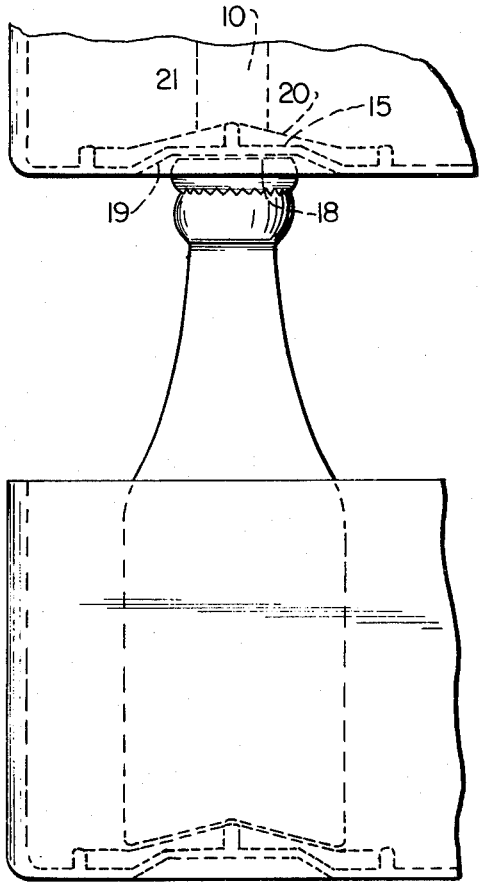
FIG. 3 is a partial side elevation of two containers in accordance with FIGS. 1 and 2 in stacked relationship with a typical bottle therein.

Referring now to the figures in detail, it will be seen that the container or box of the present invention has the overall shape of a parallelepiped with rectangular side and end walls and a bottom wall, these walls being unitarily and integrally formed. These side and end walls form the outer limits of the box, within which are longitudinal inner walls 1 and transverse inner walls 2 which form partitions or dividing walls to divide the interior of the box into a plurality of substantially square cells 3 which are shaped and dimensioned to conveniently receive the bottom portions of bottles. As will be observed in FIG. 3, the height of the walls is significantly less than the bottles to be received therein. The box has rounded inner corners 4, the corner sections of the box 5 constituting a double wall structure with substantially parallel inner and outer portions with the corner portion thereof appropriately thickened to impart strength and rigidity to the box structure and to permit correct stacking of the boxes when they are empty.

The end walls of the box have, on the upper portions thereof, a crosspiece 6 extending between the corner portions to form a handle, the horizontal thickness of the handle portions being substantially equal to the corner structures, thus forming essentially an extension of the corner structures across the ends of the box. Immediately below the handle is provided a rectangular opening 7, in the form of a slot, extending between the reinforced corner structures, through which it is easy to introduce a hand to hold the box handle firmly. On both faces of the sections reinforcing the corners, there are two groups or sets of elongated notches or grooves 8 which are diagonally placed with respect to the vertical plane of the box, the two sets in each pair on a corner surface being in a crossed relationship, i.e., extending generally perpendicular to each other. With these grooves, when the boxes are placed adjacent each other, there is a friction surface between them which makes accidental slippage of the boxes relative to each other substantially impossible. Between the two groups of notches there is also a generally oval perforation 9 to allow for the handling of the box by mechanical means.

The diagonally extending grooves 8 are defined by diagonally extending ridges which extend between the grooves 8. The pairs of grooves and ridges on opposite end and side walls are vertically offset relative to each other. In this manner, the grooves of one container will interlock with the ridges of an adjacent container when the two containers are placed laterally adjacent each other. The interlocking of the ridges and grooves will inhibit slipping between two adjacent containers. Since the ridges and grooves extend diagonally, the interlocking thereof will inhibit relative lateral movement between two adjacent containers.

As previously indicated, within the box is a number of cells, the number thereof varying in accordance with the size of the bottles to be retained within the box. The cells are formed by dividing walls 1 extending longitudinally and walls 2 extending transversely, these being unitarily formed with the bottom and outside walls of the box, the outer walls also forming the outer limits of the peripheral cells thereof.

Figure 2:
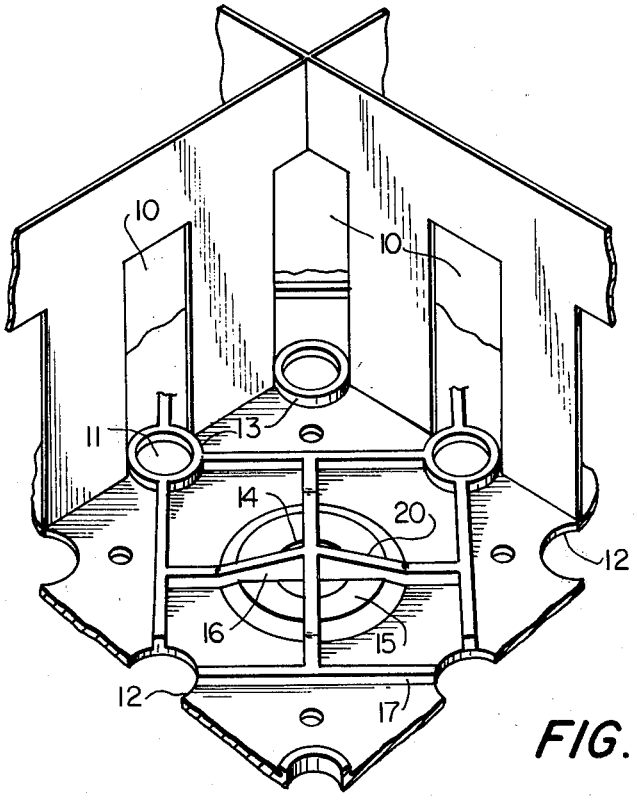
FIG. 2 is an enlarged partial perspective view of one cell of the container of FIG. 1, in partial section.
Figure 4:
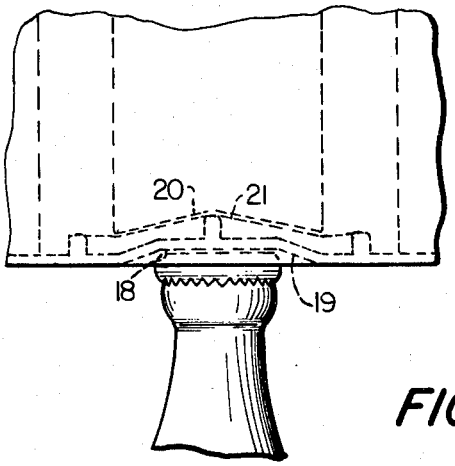
FIG. 4 is a partial side elevation of the bottom of a box showing the top of a bottle in cooperation therewith.

The cells, as more clearly shown in FIG. 2, are provided at the centers of the walls defining each cell and at the corners a vertical opening 10 which extends upwardly from the inner surface of the bottom wall to about three-quarters of the height of the interior walls. Beneath each such opening is a circular hole or perforation 11 through the bottom of the box. Because of this, the hole corresponding to the middle part of each dividing wall will be half in the bottom of one cell and the other half in the bottom of the adjacent cell. As to the perforation lying in the corners of the cells, a quarter part of each, approximately, will lie in each of the four contiguous cells involved, the corner opening being identified as a hole 12 in FIG. 2. It will be recognized that the corner holes and side holes are not provided in the side and end walls of the box, nor at the intersections of the inner walls with the outer walls of the container constituting the periphery of the box.

All of the above-described perforations have peripheral annular flanges 13, the purpose of which is to impart additional rigidity to the bottom of the box, in addition to the saving of material which is accomplished by these openings.

There is also provided in the center of each cell, in the bottom wall thereof, an opening 14 which can have a diameter similar to that of the holes 12 and 11. Of greater significance, however, is the fact that the central openings 14 have a diameter smaller than that of the mouths or caps of the bottles which will be placed in the boxes. On the inner surface of the bottom wall defining hole 14, there is a conical annular bulge 15, defining an inwardly and upwardly tapering surface from the flat portion of the bottom wall to opening 14, the height of the bulge 15 being approximately half the diameter of the hole. A pair of crossed ribs 16 extend across the bulge and the hole to provide a support for the bottle, as will be described. The outer ends of ribs 16 intersect additional ribs 17 which lie in a generally square configuration, the corners thereof intersecting annular flanges 13 around holes 11. As will be seen, this square is rotated 45° with respect to the base outline of the cell. Thus, the corners of the ribs point to the middle part of each side forming the bottom of the cell, thus making contact with the annular flanges and creating a series of network of ribs extending entirely across the interior of the bottom wall of the box. This structure gives the box great rigidity as will easily be recognized.

On its outer surface, the bottom of the box presents a series of perforations or holes in longitudinal and transverse rows. The perforations at the centers of the cells' bottoms are crossed by ribs and are, at the same time, surrounded by depressions 18 which extend inwardly in a generally conical configuration, having sloping edge surfaces 19. This depression is of the same diameter as that of the bulge 15 surrounding the hole on the inner surface of the box. Thus, the thickness of the box material itself is not significantly decreased and the strength of the box is not impaired.

With this arrangement, when boxes filled with bottles are stacked one upon the other, the bottom of one box at the location of opening 14 will rest upon the cap or mouth of the bottle which is in the next lower box, the inward depression in the bottom of the box providing certain location of the upper box relative to the lower with no possibility of accidental slippage, as the upper edge of each bottle extends into the slight depressions on the outer surfaces of the box bottom. Additionally, when the top box is removed from a stack of boxes, there is little possibility of breakage or opening of the bottles because these bottles slip smoothly out of the conical depressions first, because of the large diameter of the recesses and, furthermore, because no ribs are formed on the outside surface of the bottom wall so that the outside surface of the bottom wall does not have a downwardly extending wall to engage the upper edge of the bottle.

It will also be recognized that there is substantially no possiblity of breakage of the ribs which support the boxes holding the bottles first, because since the hole is of a smaller diameter than that of the bottle mouth, the mouth does not press exclusively against the crossed ribs but also on the conical edge of the hole reinforced inside by the annular extension described which is also part of the network of ribs covering the box bottom, all of this being integrally formed. Additionally, the stress upon a crossed rib is passed on to the base of the bottle placed within the cell. For this purpose, the interior surface of the rib within the cell is not flat but is curved or tapered, being higher at its central portion and decreasing in height outwardly toward the ends thereof. Thus, as the bottoms of the bottles have a generally hemispherical concavity, the rib will rest perfectly on its inside 21, the holding stresses being relatively evenly distributed, rather than being supported only at the periphery of the bottle as would occur if the crossed ribs were flat.

While one advantageous embodiment has been chosen to illustrate the invention, it will be understood by those skilled in the art that various changes and modifications can be made therein without departing from the scope of the invention as defined in the appended claims.

What is claimed is:

1. An improved container for holding and transporting bottles and the like comprising a unitarily formed parallelepiped container having pairs of rectangular side and end walls, a bottom wall and a plurality of longitudinally and transversely extending inner walls, said inner walls intersecting to divide said container into a plurality of cells adapted to receive bottles;

means at the corner junctions of said side and end walls forming a double wall structure including spaced, parallel wall portions;

said end walls including means extending between the upper portions of said corner junctions defining a handle;

means in said inner and end walls defining spaced apart openings extending upwardly from said bottom wall, at least some of said openings being located at the intersections of said inner walls;

means in said bottom wall defining a first plurality of generally circular holes, at least some of which are located below said openings;

means in said bottom wall defining a second plurality of holes, each of the holes of said second plurality being substantially centrally located in said cells and being of a smaller diameter than the tops of bottles to be received in said cells;

rib means integrally formed on said bottom wall for improving the rigidity thereof, said rib means including a first plurality of ribs extending across the inner surface of said bottom wall between the holes of said first plurality of holes;

a plurality of annular flanges extending upwardly from the inner surface of said bottom wall surrounding each of said first plurality of holes and connected to said first plurality of ribs;

a second plurality of ribs extending radially across and outwardly from the holes of said second plurality of holes, pairs of said second ribs extending diagonally across said cells perpendicular to each other and intersecting at the centers of said second plurality of holes, said second plurality of ribs being connected to said first plurality of ribs, said first plurality of ribs forming, in each cell, a square rotated 45° from the peripheral edges of the cell; and each of said second plurality of ribs being thicker at the center thereof than at either end, the upper surfaces thereof being tapered to engage a generally concave bottle bottom.

2. A container according to claim 1 wherein said means defining said second plurality of holes each comprises upwardly and inwardly generally conical sloping surfaces in the inner and outer surfaces of said bottom wall, for receiving, on said outer sloping surface, the top of a bottle below said surface when a plurality of filled containers are stacked, whereby stress is transferred through said second ribs from a bottle in one container to a bottle in a next lower container.

3. A container according to claim 1, wherein said end and side walls include at each of said corner junctions, pairs of sets of diagonally extending grooves defined by diagonally extending ridges formed as unitary parts of said container, one set of each pair extending in a direction perpendicular to the other set of the pair;

said pairs of grooves and ridges on opposite end and side walls being vertically offset relative to each other;

whereby the grooves of one container will interlock with the ridges of an adjacent container when two containers are placed laterally adjacent each other to inhibit slipping between the two adjacent containers.

4. A container according to claim 1, wherein openings are provided in said double wall structure of said end and side walls adjacent said corner junctions to permit handling of the container by mechanical devices.

5. A container according to claim 1, wherein the outside surface of said bottom wall is free of ribs.

* * * * *